US005520522A

United States Patent [19]

Rathore et al.

[11] Patent Number: 5,520,522

[45] Date of Patent: May 28, 1996

[54] VALVE ARRANGEMENT FOR A MICRO PUMP

[75] Inventors: Amer R. Rathore; Shigeo Okamoto; Teruo Mori, all of Tokyo, Japan

[73] Assignee: TDK Corporation, Tokyo, Japan

[21] Appl. No.: 309,476

[22] Filed: Sep. 21, 1994

[30] Foreign Application Priority Data

Oct. 1, 1993 [JP] Japan ..... 5-269536

[51] Int. Cl.[6] ..... F04B 53/10

[52] U.S. Cl. ..... 417/322; 417/571; 137/904; 137/533.17

[58] Field of Search ..... 417/322, 569, 417/571; 137/904, 533.17

[56] References Cited

U.S. PATENT DOCUMENTS

| | | | |
|---|---|---|---|
| 1,186,209 | 6/1916 | Keppel | 137/533.17 |
| 1,963,685 | 6/1934 | Shimer | 137/904 |
| 2,074,329 | 3/1937 | Gieseman | 137/533.17 |
| 3,457,948 | 7/1969 | Niedermayer | 137/533.17 |
| 4,726,741 | 2/1988 | Cusack . | |
| 4,795,317 | 1/1989 | Cusack . | |
| 4,795,318 | 1/1989 | Cusack . | |
| 4,804,314 | 2/1989 | Cusack . | |
| 4,815,946 | 3/1989 | Cusack . | |
| 4,927,334 | 5/1990 | Engdahl et al. . | |
| 5,199,860 | 4/1993 | Stegmaier | 417/569 |

FOREIGN PATENT DOCUMENTS

| | | | |
|---|---|---|---|
| 160576 | 9/1983 | Japan | 417/571 |
| 5-60059 | 3/1993 | Japan . | |

*Primary Examiner*—Richard A. Bertsch
*Assistant Examiner*—Roland G. McAndrews, Jr.
*Attorney, Agent, or Firm*—Oblon, Spivak, McClelland, Maier & Neustadt

[57] ABSTRACT

A micro pump which employs magnetostrictive or electrostrictive elements as solid drive elements and is capable of self-priming even though its flow rate is increased. In the pump, disk-shaped valve elements respectively having tapered protrusions on one side are used as check valves to reduce weight and made to follow the motion of liquids so as to smoothly open and close. Retainers for regulating the gap h between the valve seats and the valve elements are respectively provided with tapered recesses for guiding the protrusions of the valve elements, whereby the valves are prevented from contacting the retainers, thus undergoing less friction therewith, to ensure smooth opening and closure of the valves. Moreover, ringlike or sheetlike elastic materials are provided on the bottoms of the recesses to improve responsivity in the direction in which the valves are closed.

16 Claims, 6 Drawing Sheets

VALVE ARRANGEMENT FOR A MICRO PUMP

FIELD OF THE INVENTION

The present invention relates to a micro-pump, capable of self-priming, for transferring liquids by means of back and forth motion of a piston in effective engagement with solid drive elements such as magnetostrictive or electrostrictive element as driving means.

BACKGROUND OF THE INVENTION

FIG. 5 is a sectional view of a conventional micro pump of the sort mentioned above, wherein reference numeral 1 denotes a cylindrical pump body. A head member 2 having a suction port 2*a* and a discharge port 2*b* is fixedly fitted into one end of the pump body 1, nozzles being connected to the respective ports 2*a*, 2*b*. An external threaded screw 3*b* at the lower end of a magnetostrictive material 3 (i.e., the lower end on the page face and may be turned to any direction when the pump is operated) is screwed into the internal thread la of the body 1 in order to accommodate the magnetostrictive material 3. A coil 4 is wound on the intermediate portion 3*a* of the magnetostrictive material 3, which incorporates an upper large-diameter portion 3*c* for use as a piston and is also fitted with sealing rings 17 in the respective outer peripheral grooves 3*d* of the large-diameter portion 3*c*, so that a chamber 5 is formed in between the magnetostrictive material 3 and the head member 2.

The head member 2 includes a valve seat 2*e*, a ball 6, a spring 7 for urging the valve element 6 to the valve seat 2*e*, and a spring shoe 8, these being provided in an inlet flow channel 2*c* communicating with the suction port 2*a*. The head member 2 also includes in the opposite direction a valve seat 2*f*, a ball 9, a spring 10 and a spring shoe 11, these being provided in an outlet flow channel 2*d*.

In the pump as mentioned above, there is produced an alternating magnetic field each time a driving power supply 12 energizes and deenergizes the coil 4 alternately and repeatedly. As a result, the magnetostrictive material 3 elongates and contracts, whereby the large-diameter portion 3*c*, which acts as a piston, ascends and descends to enlarge or reduce the space of the chamber 5. In the discharge condition, the valve element 9 of the outlet valve ascends to open and the valve element 6 of the inlet valve also ascends to close. On the other hand, in the suction condition, the valve element 9 of the outlet valve descends to close and the valve element 6 of the inlet valve also descends to open. The liquid discharge and suction conditions are alternately repeated so as to cause the liquid sucked from the suction port 2*a* to flow into the chamber 5 and to flow out of the discharge port 2*b*.

By providing a permanent magnet for applying a bias magnetic field to the magnetostrictive material, the magnetic field produced in the coil becomes smaller and the size of the coil can be made small-sized. Therefore, a greater discharge quantity is readily obtainable.

However, the springs 7, 10 that are intended for use in such a conventional micro pump and offer delicate spring force as well as excellent durability are not of standard available size. Even though it is attempted to make the pump operate to suck and discharge a liquid in a steady state with the presence of air in the chamber 5 when it is started at a frequency in the range of, for example, 50 Hz~60 Hz, that is, by means of a commercial power supply, self-priming ξto suck the liquid into the chamber 5 single-handedly is infeasible because the springs 7, 10 are too stiff. In other words, the chamber 5 will have to be filled with a liquid beforehand and the problem is that such work is troublesome.

In order to solve the foregoing problem, it is proposed a micro pump so constructed that springs can be dispensed with as shown in a sectional view of FIG. 6A. In FIG. 6A, reference numeral 13 denotes a housing with an internal thread 13*a* which is screwed to an external thread 1*a* at the lower end of a cylindrical pump body 1. A bobbin 14 with a coil 4 wound thereon is abut against the housing 13 to accommodate the bobbin in the cylindrical pump body 1. A magnetostrictive material 3 is disposed into the bobbin 14 and also made to abut against the housing 13 using a positioning yoke 15.

Reference numeral 16 denotes a first spring shoe which abuts against the upper end of the magnetostrictive material 3. The first spring shoe 16 has an outer peripheral groove 16*a* to fit a buffering ring 42 made of rubber or plastic so as to make the ring 42 abut against the inner peripheral face of the body 1. Moreover, the spring shoe 16 has a boss 16*b* projecting on its central surface externally on which bellivile springs 18, a flat washer 20 and a second spring shoe 21 are movably mounted. Reference numeral 22 denotes a piston which is fixed by screwing an external thread 22*a* into an internal thread 16*c* provided in the center of the boss 16*b* of the first spring shoe 16 and has a cylindrical vertical wall 22*b* on its outer periphery.

Reference numeral 23 denotes a valve-fitting end plate which has an outer peripheral groove 23*a* to fit a sealing ring 43 made of rubber or plastic so as to make the sealing ring 43 abut against the inner peripheral face of the vertical wall 22*b* of the piston 22. Further, a cylindrical spacer 24 is provided between the second spring shoe 21 and the flange 23*b* of the end plate 23. Reference numeral 25 denotes a housing on the head side, in which an internal thread 25*b* is screwed with an external thread 1*b* at the upper end of the pump body 1. In this condition, the flange 23*b* of the end plate 23 is pressed by the flange 25*a* of the housing 25 against the spring force of the bellivile springs 18. These members are accommodated in such a state. Further, a chamber 26 is formed between the end plate 23 and the piston 22.

Reference numerals 27, 39 denote an inlet valve and an outlet valve fitted to the end plate 23, respectively. The inlet valve 27 is fitted by screwing the external thread at the leading end of a nozzle 27*a* into the threaded hole 23*c* of the end plate 23 and a valve body 28 is screwed to the nozzle 27*a*. A nozzle joint 29 is also screwed to the valve body 28. As shown in an enlarged view of FIG. 6B, in the valve body 28, there are provided a valve seat 44, a ball 6 and a spacer 30 for regulating the gap between the ball 6 and the valve seat 44 by setting the depth of a retainer 32 to constitute a check valve.

More specifically, the retainer 32 is fitted by screwing an external thread on the outer periphery of the retainer 32 into the internal thread 28*c* of the valve body 28. The retainer 32 is equipped with a gap-adjusting screw 31 which is vertically movable, so that the gap h between the ball 6 and the valve seat 44 is made adjustable by vertically moving the screw 31.

The outlet valve 39 is fitted by screwing the head of the external thread into the threaded hole 23*d* of the end plate 23. Further, in a valve body 34, there are provided a valve seat 45, a ball 9, a spacer 36 and a retainer 38 having a screw 37 in the direction opposite to what is followed in the inlet valve 27 to constitute a check valve. The gap between the ball 9 and the valve seat 45 is made adjustable likewise. A nozzle joint 35 is also screwed to the outlet valve 39.

When the coil 4 in the aforementioned micro pump is energized, the magnetostrictive material 3 elongates against the spring force of the bellivile spring 18 and the piston 22 moves upward, thus causing the chamber 26 to contract. As the magnetostrictive material 3 contracts when the coil 4 is subsequently deenergized, the piston 22 is lowered by the spring force of the bellivile spring 18 using the first spring shoe 16 and the chamber 26 expands. As the chamber 26 expands or contracts, the balls 6 and 9 inside the valves move vertically, that is, the liquid discharge condition resulting from the ascension of the balls 6, 9 and the liquid suction condition resulting from the descent of the balls 6, 9 are alternately repeated. The pump can thus prime itself and start transferring liquid.

When driver using conventional AC voltage the pump of FIG. 6 (same as pump of FIG. 5 without valve springs) attains a low self-priming height because of the great inertia force of the balls 6 and 9 as shown in a characteristic drawing of FIG. 7 when it is attempted to increase a flow rate by widening the gap h. Consequently, there has arisen the problem of rendering it infeasible to devise a micro pump whose self-priming level is high enough for practical use and which offers a high flow rate.

SUMMARY OF THE INVENTION

In view of the actual situation above, an object of the present invention is to provide such a micro pump, using solid drive elements, which is capable of maintaining a high self-priming level even when its flow rate is increased.

In order to accomplish the object above according to the present invention, a micro pump for transferring liquids employs solid drive elements as piston driving means and uses check valves as inlet and outlet valves in order to minimize the moving distance of valve members, wherein a disk-shaped member having a tapered protrusion on one side is used as a valve element in each check valve, wherein a retainer for regulating the gap between the valve element and the valve seat is provided with a tapered recess for guiding the protrusion of the valve element, and wherein an elastic, ring- or sheet-like material is provided at the bottom of the recess.

The disk-shaped members are used as the respective inlet and outlet valves according to the present invention with the effect of reducing the weight of the valves as compared with balls and increasing the area to which the flowing force of a liquid is applied. While the valve is opened, moreover, the disk-shaped valve comes in contact with the elastic material provided in the tapered recess of the retainer is urged in the direction in which the valve is closed on receiving counter-force from the elastic material, so that smooth opening and closure operations are performed. Since the tapered protrusion of the disk-shaped valve is guided to the tapered recess of the retainer, the position of the disk-shaped valve is precisely determined. The corresponding relationship between the tapered portions makes the valve-to-retainer friction frequency lower than what is in a case where the valve is guided by a cylindrical guide and reduces the degree of arresting the movement of the valve as the valve makes contact with the retainer. With this arrangement, the valve smoothly operates to open and shut, and is therefore capable of self-priming while offering a greater flow rate by increasing the gap between the valve and valve seat.

DETAILED DESCRIPTION OF PREFERRED EMBODIMENTS

Figure 1A:
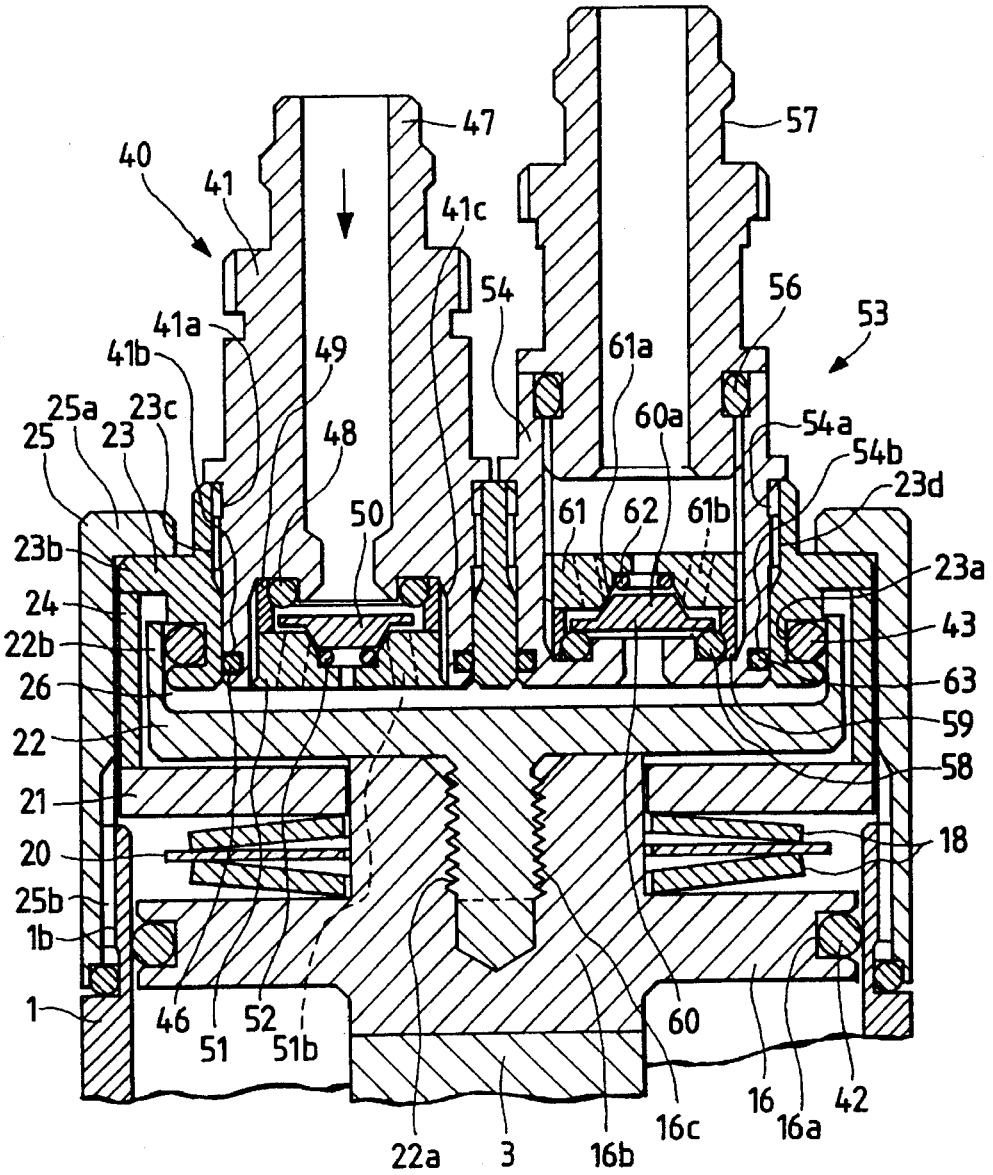
FIG. 1A is a sectional view of a micro pump embodying the present invention.
Figure 1B:
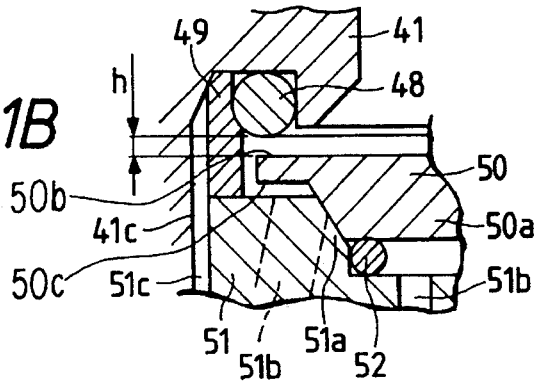
FIG. 1B is an enlarged view of the gap between the disk-shaped valve element and the valve seat.
Figure 6A:
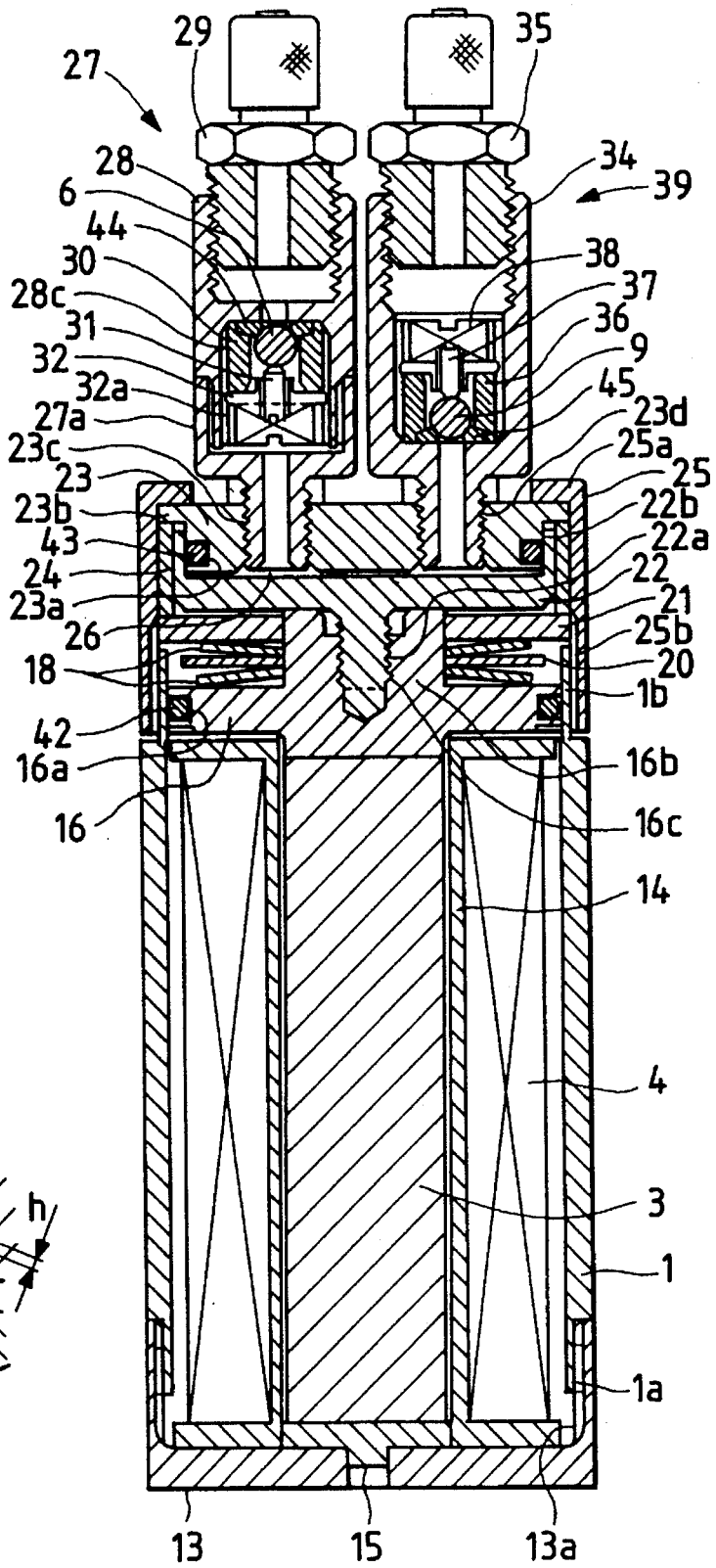
FIG. 6A PRIOR ART
FIG. 6A is a sectional view of the conventional micro pump.
Figure 6B:
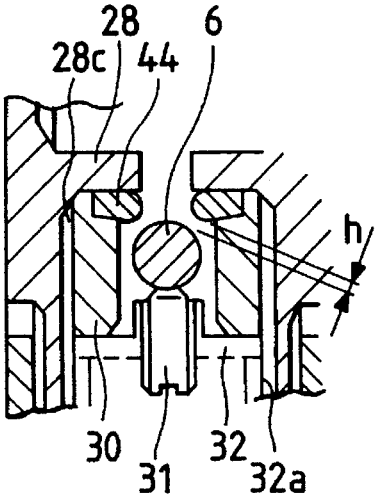
FIG. 6B PRIOR ART
FIG. 6B is an enlarged view of the gap between the ball and the valve seat.

FIG. 1A is a sectional view of a micro pump embodying the present invention and FIG. 1B an enlarged view of the gap portion between the disk-shaped valve body and the valve seat of the pump. Incidentally, difference between this embodiment of a micro pump and what is shown in FIG. 6 as a conventional pump lies only in the structure of a check valve. The same reference characters in FIG. 1A designate same parts or sections demonstrating functions equivalent to those referred to in FIG. 6.

In FIG. 1A, reference numeral 40 denotes an inlet valve, which is fitted up by screwing an external thread 41*a* on the outer periphery of a valve body 41 into the threaded hole 23*c* of an end plate 23. The gap between the inlet valve 40 and the end plate 23 is sealed by fitting a sealing ring 46 of rubber, plastic or metal into a groove 41*b* provided in the outer periphery of the valve body 41. Moreover, members constituting a check valve as illustrated in an exploded perspective view of FIG. 3 are accommodated in a circular recess 41*c* (see FIG. 1B) whose inner peripheral surface is provided with a threaded groove.

Figure 3:
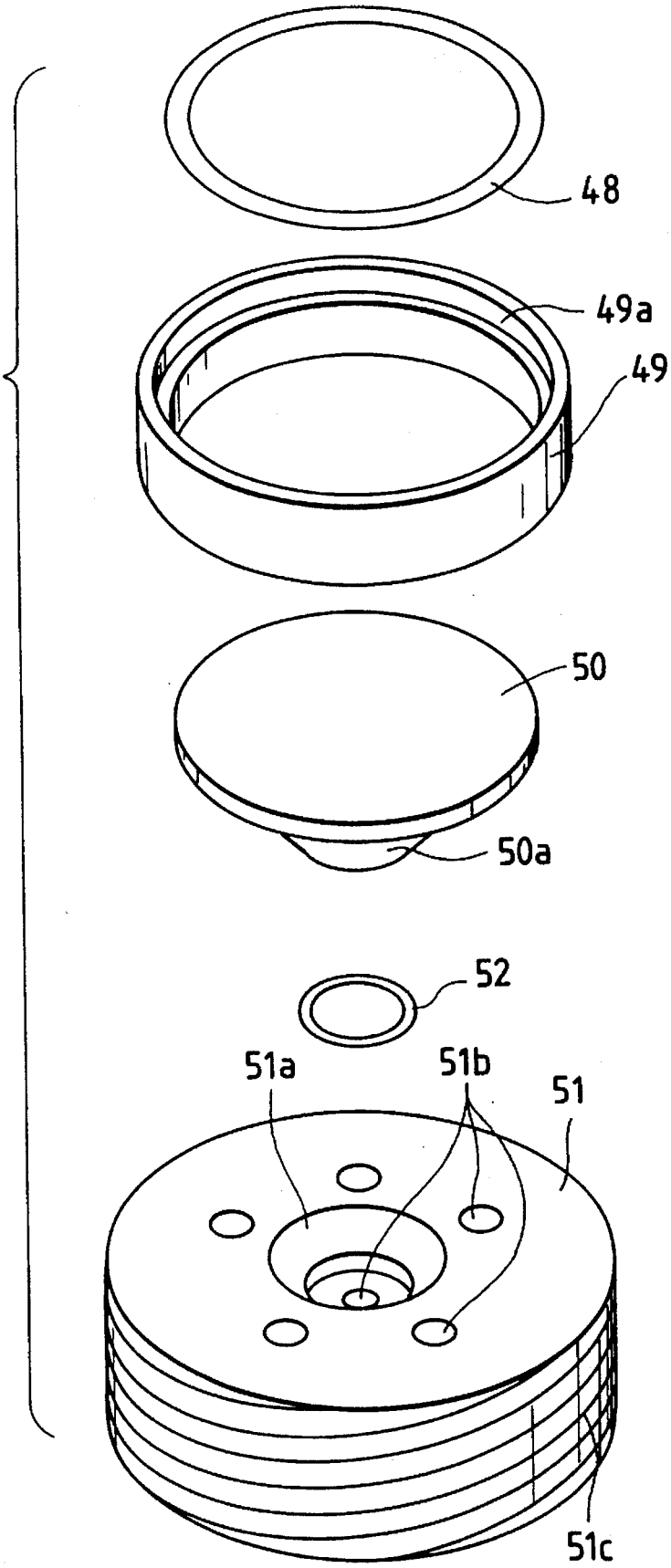
FIG. 3 is an exploded perspective view of the component member of the check valve in the micro pump according to the present invention.

As shown in FIGS. 1A, 1B and 3, the recess 41*c* also accommodates a valve seat 48 in the form of a rubber or plastic ring, a cylindrical metal or plastic spacer 49 for regulating the gap with a stepped portion 49*a* for holding the valve seat 48, a disk-shaped valve element 50 made of resin or metal material containing glass fiber for the purpose of reducing weight according to the present embodiment, the valve element 50 having a tapered protrusion 50*a* on its one side, and a retainer 51 made of metal or resin. The retainer 51 has, on its one side, a tapered recess 51*a* for guiding the tapered protrusion 50*a* of the disk-shaped valve element 50 and a hole 51*b* as a path of fluid flow passing therethrough from top to bottom, a rubber or plastic ringlike elastic material 52 being fitted to the bottom of the recess 51*a*. An external thread 51*c* on the outer periphery of the retainer 51 is screwed into the threaded groove of the recess 41*c* of the valve body 41 and jammed up to the position regulated by the spacer 49, whereby the check valve is organized in such a state that, as shown in FIG. 1B, a gap h is retained between the valve seat 48 and the disk-shaped valve element 50. A nozzle joint section is formed in the upper portion 47 of the inlet valve 40.

Reference numeral 53 denotes an outlet valve, which is fitted up by screwing an external thread 54*a* on the outer periphery of a valve body 54 to the threaded hole 23*c* of an end plate 23. A nozzle joint 57 is screwed via a sealing ring 56 into the outlet valve 53. The outlet valve 53 contains a valve seat 58 formed with a rubber or plastic ring in the direction opposite to the case of the inlet valve 40, a metal or plastic spacer 59, a disk-shaped, metal or plastic valve element 60, and a retainer 61 made of metal or resin compound into which a rubber of plastic ringlike elastic material 62 is fitted. The check valve is thus arranged with the aforementioned members, which are similar to those constituting the inlet valve 40. Reference numeral 63 denotes a rubber, plastic or metal sealing ring installed in the outer peripheral groove 54*b* of the valve body 54. In this case, the elastic materials 52, 62 for use may be formed from a sheet.

Figure 2:
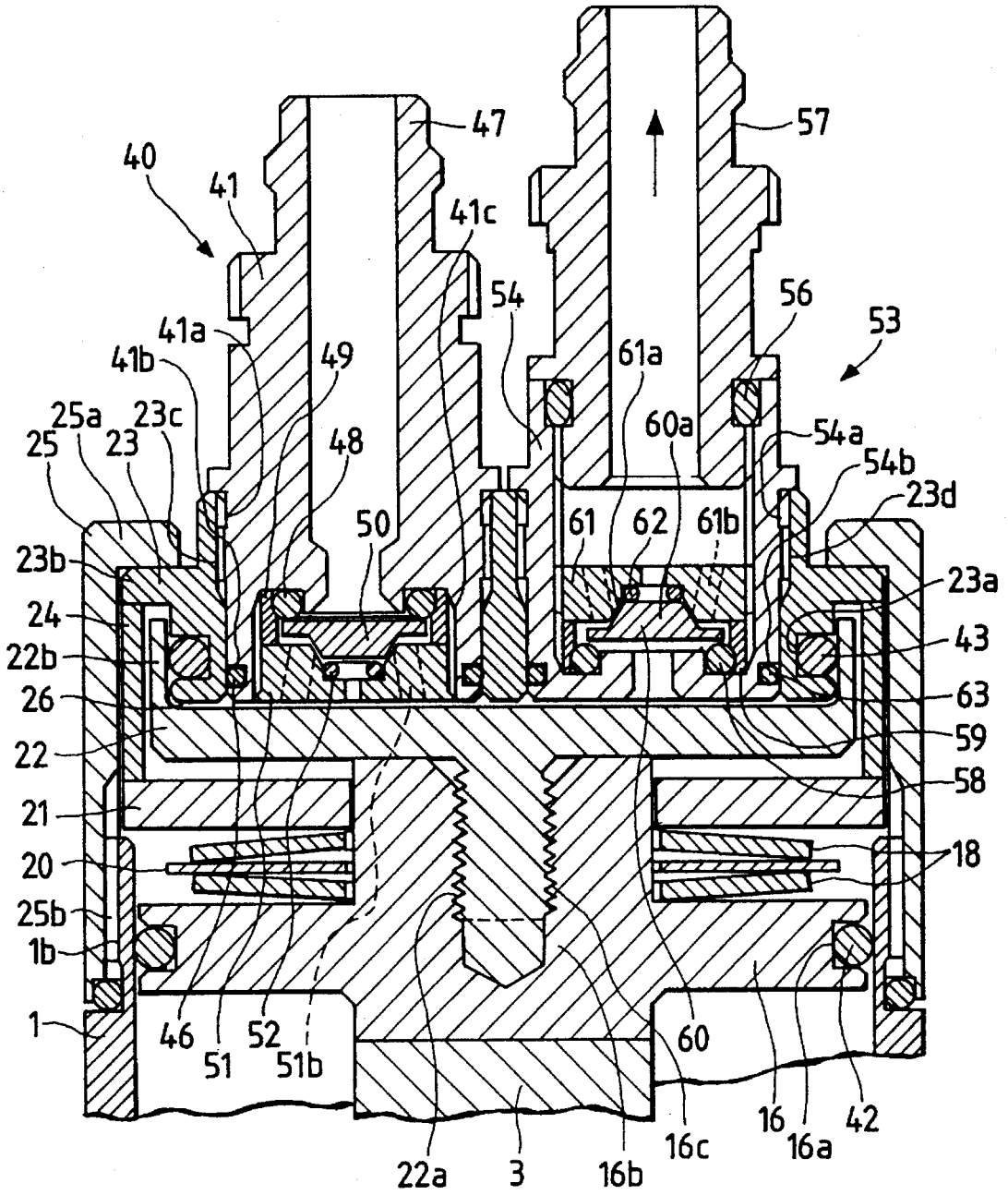
FIG. 2 is a sectional view of the micro pump in the discharge stroke condition according to the present invention.

With the arrangement above, a chamber 26 enlarges during the suction stroke of the pump in which a piston 22 is forced back by elastic members in the form of bellivile springs 18 when the supply of power to a coil 4 is stopped and the valve element 50 of the inlet valve 40 is separated from the valve seat 48 to cause the valve to open, whereas the valve element 60 of the outlet valve 53 comes in tight contact with the valve seat 58 to cause the valve to close. As shown in FIG. 1B, the valve element 50 includes a first side 50*c* which contacts the valve seat 48 in the closed position. In addition, a second side of the valve element 50 includes an annular surface 50*c*, with the tapered protrusion 50*a* extending from within the annular surface 50*c*, such that the annular surface 50*c* extends about the base of the tapered protrusion 50*a*. As also shown in FIG. 1B, the annular surface 50*c* is spaced from the hole or outlet opening 51*b* when the valve element 50 is in the open position. A liquid thus flows into the chamber 26 via the gap h and the hole 51*b* of the retainer 51. During the subsequent discharge stroke, the chamber 26 contracts when the piston 22 is lifted as a magnetostrictive material 3 elongates and as shown in a sectional view of FIG. 2 the inlet valve 40 and the outlet valve 53 are respectively closed and opened, whereby the liquid in the chamber 26 is discharged via the gap h and the hole 61*b* of the retainer 61. While the suction and discharge operations are alternately repeated, the liquid is fed and discharged.

Figure 4:
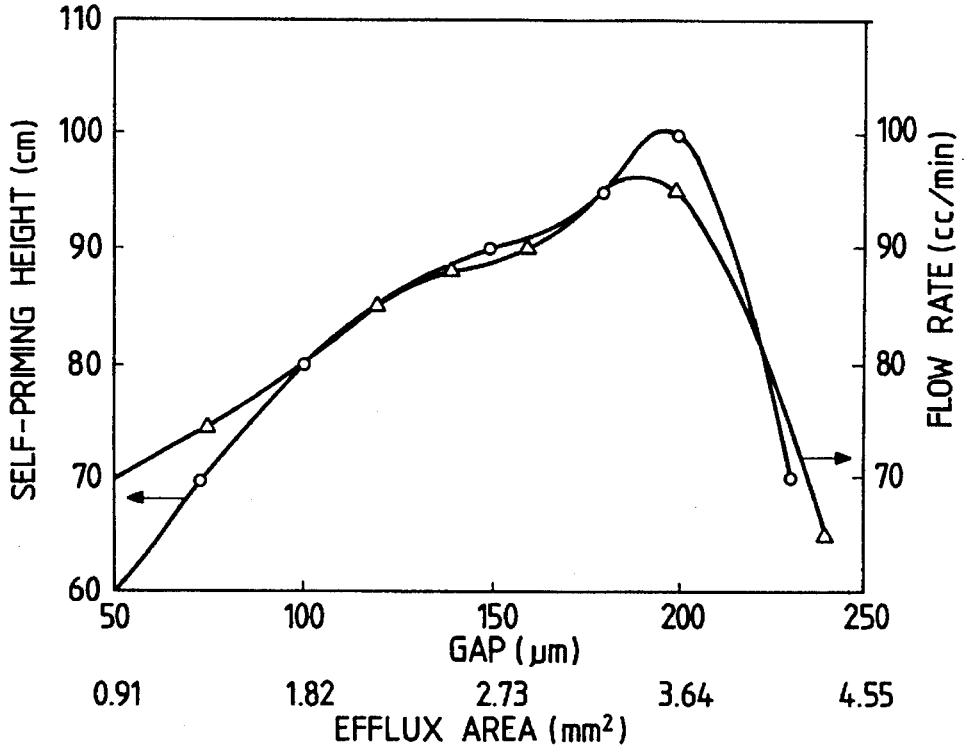
FIG. 4 is a graphical representation showing the characteristics of the micro pump according to the present invention.

Since the disk-shaped valve elements 50, 60 are used in the respective inlet and outlet valves 40, 53, it is possible to make the valve bodies lightweight and to enlarge the area to which the flowing force of the liquid is applied, so that the flowing force of the liquid flowing out of the holes 51*b*, 61*b* of the retainers 51, 61 is efficiently received thereby. Moreover, the repercussion responsivity of the disk-shaped valve elements 50, 60 improves as the counterforce of the elastic materials 52, 62 incorporated in the retainers 51, 61 is applied to the respective disk-shaped valve elements 50, 60 when the open condition of the valve is shifted to the closed condition thereof. Further, the tapered protrusions 50*a*, 60*a* of the disk-shaped valve elements 50, 60 are respectively guided by the tapered recesses 51*a*, 61*a* of the retainers 51, 61, whereby the disk-shaped valve elements 50, 60 are precisely positioned and besides prevented from coming in contact with the retainers 51, 61 with the effect of lowering the degree of arresting the movements of the valve elements 50, 60. The responsivity in the movements of the disk-shaped valve elements 50, 60 corresponding to the variations of the flowing force of the liquid as the piston ascends or descends is made improvable, and the vertical motions of the valve elements 50, 60, that is, smooth opening and closure of the valve are ensured. A graphical representation of FIG. 4 showing the characteristics of the pump according to the present invention depicts the feasibility of improving self-priming height characteristics even if the gap h increases.

Figure 7:
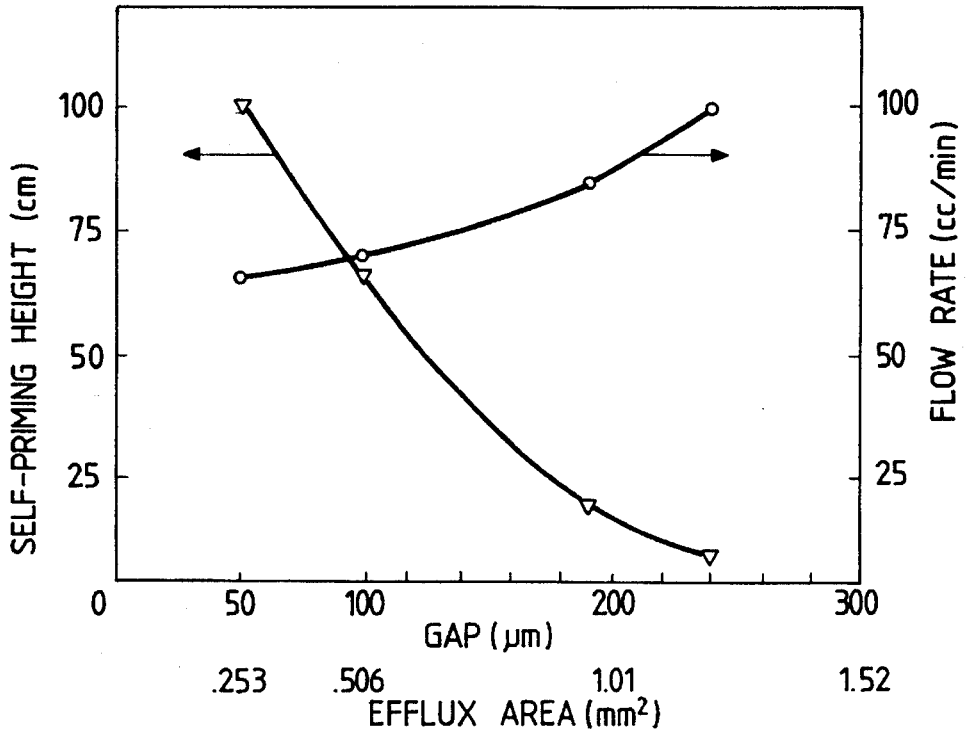
FIG. 7 is a graphical representation showing the characteristics of the conventional micro pump.
Figure 5:
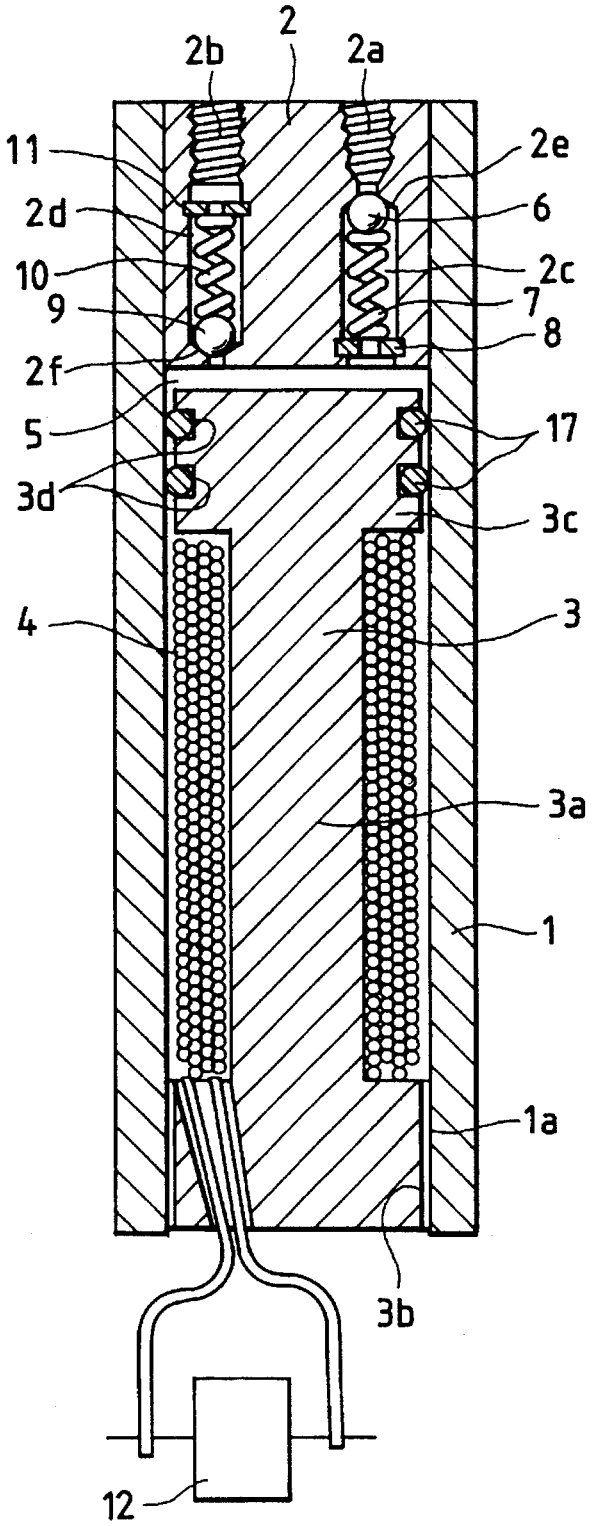
FIG. 5 PRIOR ART
FIG. 5 is a sectional view of a conventional micro pump.

A description will subsequently be given of specific examples. Referring to the pump of FIG. 6 using a ball, a limit was, as shown in FIG. 7, 50 μm (as for the reflux area, 0.253 $mm^2$) as long as the gap h is concerned so as to justify self-priming up to a height of 100 cm on condition that drive frequency is set to 50 Hz, the stroke of the piston 22 to 30 μm, the area of the chamber 26 to 5.68 $cm^2$ the diameters of the ball 6, 9 to 3.629 mm, and their weight to 0.040 g. The flow rate then was approximately 60 cc/min with respect to the flow rate 100 cc/min of the piston 22. In the case of a pump embodying the present invention, while the stroke of the piston 22 and the area of the chamber 26 were set the same as those of FIG. 6, there were employed disk-shaped valve elements 50, 60 whose diameters and weight were respectively set to 5.8 mm and 0.040 g, whereupon with the gap h set at 200 μm (as for the efflux area, 0.253 $mm^2$) as shown in FIG. 4, the flow rate could be increased to approximately 95 cc/min.

In addition to magnetostrictive elements, electrostrictive elements, optostrictive elements and thermal expansion elements may be .employed as the solid drive elements.

Furthermore, by providing a permanent magnet for applying a bias magnetic field to the magnetostrictive material, the magnetic field produced in the coil becomes smaller and the size of the coil can be made small-sized. Therefore, a greater discharge quantity is readily obtainable.

Since the disk-shaped valve members are used in the respective inlet and outlet valves constituting the check valve, it is possible to make the valve bodies lightweight and to enlarge the area to which the flowing force of a liquid is applied, so that the flowing force of the liquid is efficiently received thereby. Moreover, the repercussion responsivity of the disk-shaped valve element improves as the counterforce of the elastic material provided in the tapered recess of the retainer is applied to the disk-shaped valve element when the open condition of the valve is shifted to the closed condition thereof. Further, the tapered protrusion of the disk-shaped valve element is guided to the tapered recess of the retainer, whereby the disk-shaped valve element is precisely positioned and besides prevented from coming in contact with the retainer with the effect of lowering the degree of arresting the movement of the valve element as compared with a case where such a valve element is guided by a cylindrical guide. Consequently, the responsivity in the movement of the valve element corresponding to the variations of the flowing force of the liquid as the piston moves is made improvable and this makes it possible to provide a micro pump offering self-priming height and a flow rate greater than those of any of the conventional pumps.

What is claimed is:

1. A micro pump for transferring a liquid comprising:

a cylinder body;

a piston disposed in said cylinder body;

piston driving means for driving said piston;

an inlet check valve and an outlet check valve, at least one of said inlet check valve and said outlet check valve including:

a valve seat;

a disk-shaped valve element movable between an open position and a closed position, said diskshaped valve element including first and second sides, wherein said first side contacts said valve seat when said disk-shaped valve element is in said closed position, said second side including an annular surface with a tapered protrusion extending from within said annular surface such that said annular surface extends about a base of said tapered protrusion;

a retainer for regulating a gap between said disk-shaped valve element and the valve seat when said disk-shaped valve element is in said open position, the retainer having a tapered recess for receiving and guiding the tapered protrusion of said disk-shaped valve element at least when said disk-shaped valve element is moved to said open position.

2. A micro pump as set forth in claim 1, wherein said retainer includes a plurality of outlet holes extending therethrough and disposed about said tapered recess.

3. A micro pump as set forth in claim 2, wherein in said open position, said annular surface of said disk-shaped valve element is spaced from said outlet holes.

4. A micro pump as recited in claim 3, further including a hole extending through said retainer and into said tapered recess.

5. A micro pump as set forth in claim 3, further including an elastic material disposed inside of said tapered recess.

6. A micro pump for transferring a liquid comprising:

a cylinder body;

a piston disposed in said cylinder body;

piston driving means for driving said piston;

an inlet check valve and an outlet check valve, each check valve including:

an inlet;

an outlet;

a valve seat disposed on an inlet side of the check valve;

a disk-shaped valve element having a tapered protrusion on one side, wherein said disk-shaped valve element is movable between an open position and a closed position;

a retainer for regulating a gap between said disk-shaped valve element and the valve seat when said disk-shaped valve element is in said open position, the retainer having a tapered recess for receiving and guiding the tapered protrusion of the valve element at least when said disk-shaped valve element is moved to said open position, and wherein said outlet extends through said retainer, said outlet including an opening disposed on a valve element side of said retainer, said opening at least partially disposed outside of said tapered recess; and an elastic material provided inside of the tapered recess.

7. A micro pump as claimed in claim 6, wherein said piston driving means is a magnetostrictive element.

8. A micro pump as set forth in claim 6, wherein said disk-shaped valve element includes first and second sides, wherein said first side contacts said valve seat when said disk-shaped valve element is in said closed position, and said second side includes an annular surface disposed about a base of said tapered protrusion.

9. A micro pump as set forth in claim 6, wherein said retainer further includes a hole extending therethrough and into said tapered recess.

10. A micro pump as set forth in claim 6, wherein said retainer includes a plurality of outlets, each having an opening on a valve element side of said retainer which is at least partially disposed outside of said tapered recess.

11. A micro pump as set forth in claim 10, wherein said retainer further includes a hole extending therethrough and into said tapered recess.

12. A micro pump for transferring a liquid comprising:

a magnetostrictive material;

a coil for flowing a current to generate an alternating magnetic field to be applied to said magnetostrictive material;

a pump body containing the magnetostrictive material and the coil;

a positioning member located on a first side of the pump body for supporting one end of the magnetostrictive element;

a piston located on a second side of the pump body, the piston being movable in a direction of elongation and contraction of the magnetostrictive element in the pump body.

a pumping chamber;

at least one elastic member for urging the magnetostrictive material in a direction in which the magnetostrictive material contracts;

an inlet check valve and an outlet check valve communicating with the pumping chamber, each check valve including:

an inlet;

an outlet;

a valve seat disposed on an inlet side of the check valve;

a disk-shaped valve element having a tapered protrusion on one side, wherein said disk-shaped valve element is movable between an open position and a closed position;

a retainer for regulating a gap between said disk-shaped valve element and the valve seat when said disk-shaped valve element is in said open position, the retainer having a tapered recess for receiving and guiding the tapered protrusion of the valve element at least when said disk-shaped valve element is moved to said open position, and wherein said outlet extends through said retainer, said outlet including an opening disposed on a valve element side of said retainer, said opening at least partially disposed outside of said tapered recess; and an elastic material provided inside of the tapered recess.

13. A micro pump as set forth in claim 12, wherein said disk-shaped valve element includes first and second sides, wherein said first side contacts said valve seat when said disk-shaped valve element is in said closed position, and said second side includes an annular surface disposed about a base of said tapered protrusion.

14. A micro pump as set forth in claim 12, wherein said retainer includes a plurality of outlets, each having an opening on a valve element side of said retainer which is at least partially disposed outside of said tapered recess.

15. A micro pump as set forth in claim 14, wherein said retainer further includes a hole extending therethrough and into said tapered recess.

16. A micro pump as set forth in claim 12, wherein said retainer further includes a hole extending therethrough and into said tapered recess.

* * * * *